US011236535B2

(12) United States Patent
Prieur

(10) Patent No.: US 11,236,535 B2
(45) Date of Patent: Feb. 1, 2022

(54) DOOR-STOPPING DEVICE WITH INFINITE HOLDING POSITIONS

(71) Applicant: André Prieur, La Garenne Colombes (FR)

(72) Inventor: André Prieur, La Garenne Colombes (FR)

( * ) Notice: Subject to any disclaimer, the term of this patent is extended or adjusted under 35 U.S.C. 154(b) by 0 days.

(21) Appl. No.: 16/771,767

(22) PCT Filed: Dec. 13, 2018

(86) PCT No.: PCT/FR2018/053266
§ 371 (c)(1),
(2) Date: Jun. 11, 2020

(87) PCT Pub. No.: WO2019/115957
PCT Pub. Date: Jun. 20, 2019

(65) Prior Publication Data

US 2021/0172223 A1 Jun. 10, 2021

(30) Foreign Application Priority Data

Dec. 13, 2017 (FR) ..... 1701303

(51) Int. Cl.
*E05C 17/22* (2006.01)
*E05C 17/20* (2006.01)

(52) U.S. Cl.
CPC ..... *E05C 17/22* (2013.01); *E05C 17/203* (2013.01)

(58) Field of Classification Search
CPC ..... E05C 17/025; E05C 17/04; E05C 17/12; E05C 17/20; E05C 17/203; E05C 17/206;
(Continued)

(56) References Cited

U.S. PATENT DOCUMENTS 2,268,976 A * 1/1942 Westrope ..... E05C 17/206 16/86 C
6,349,448 B1 * 2/2002 Breed ..... E05C 17/203 16/337

(Continued)

FOREIGN PATENT DOCUMENTS

EP 0 952 289 A1 10/1999
FR 2 981 108 A1 4/2013

(Continued)

OTHER PUBLICATIONS

International Search Report and Written Opinion, dated Mar. 19, 2019, from corresponding International Application No. PCT/FR2018/053266.

*Primary Examiner* — Jeffrey O'Brien
(74) *Attorney, Agent, or Firm* — Nixon & Vanderhye

(57) ABSTRACT

Disclosed is a door-stopping device, including a linking arm and a locking mechanism, one being rigidly connected to the leaf of the door and the other to the frame, the linking arm including at least one face intended for engaging with a braking element resting on the face of the linking arm, the braking element being controlled by a blocking element resting in a notch provided on the braking element, the blocking element engaging with resilient return element intended for exerting a pressure of the blocking element on the braking element, thus allowing the relative holding of the door in open position in any given position between the closed and fully-open positions. The device is particularly applicable to motor vehicle doors.

15 Claims, 8 Drawing Sheets

(58) Field of Classification Search
CPC ..... E05C 17/22; E05C 17/24; E05C 17/26; E05C 17/28
See application file for complete search history.

(56) References Cited

U.S. PATENT DOCUMENTS 6,370,732 B1 * 4/2002 Yezersky ..... E05C 17/203 16/82
6,467,126 B1 * 10/2002 Yezersky ..... E05C 17/203 16/86 B
6,513,193 B1 * 2/2003 Yezersky ..... E05C 17/203 16/86 A
6,681,444 B2 * 1/2004 Breed ..... E05C 17/203 16/64
6,711,778 B2 * 3/2004 Sparkman ..... E05C 17/203 16/82
6,928,694 B2 * 8/2005 Breed ..... E05C 17/203 16/82
7,076,833 B2 * 7/2006 Murayama ..... E05C 17/203 16/82
7,438,346 B1 * 10/2008 Breed ..... E05C 17/203 296/146.12
7,578,029 B2 * 8/2009 Prieur ..... E05C 17/203 16/101
7,832,051 B2 * 11/2010 Prieur ..... E05C 17/203 16/85
8,733,818 B2 * 5/2014 Hooton ..... E05C 17/003 296/146.4
8,938,852 B2 * 1/2015 Kim ..... E05F 5/00 16/82
9,567,787 B2 * 2/2017 Prieur ..... E05F 5/08
9,598,890 B1 * 3/2017 Hooton ..... E05C 17/203
9,822,570 B2 * 11/2017 Jaranson ..... E05F 15/70
10,450,783 B2 * 10/2019 Prieur ..... E05C 17/22
10,604,976 B2 * 3/2020 Kirchhoff ..... E05B 51/02
2004/0055110 A1 * 3/2004 Breed ..... E05C 17/203 16/82
2008/0271286 A1 * 11/2008 Stalhammar ..... E05C 17/203 16/84
2014/0053370 A1 * 2/2014 Tseng ..... E05C 17/28 16/82
2016/0281399 A1 * 9/2016 Seki ..... E05C 17/22
2017/0002592 A1 * 1/2017 Cervantes, Jr. ..... E05C 17/203

FOREIGN PATENT DOCUMENTS

FR 3 046 193 A1 6/2017
WO 2007/012729 A1 2/2007

* cited by examiner

DOOR-STOPPING DEVICE WITH INFINITE HOLDING POSITIONS

BACKGROUND OF THE INVENTION

Field of the Invention

This invention relates to a door-stopping device, comprising a locking mechanism and a linking arm, one being linked to the door leaf, the other to the frame, the said linking arm having at least one face intended to cooperate with a braking element pressed against the said face of the linking arm, the said braking element being controlled by a blocking element engaging inside a notch provided on the braking element, the said blocking element cooperating with resilient return means intended to exert pressure of the blocking element on the braking element, thus allowing the relative holding of the door in open position, in any given position between the closed and the fully-open positions.

The invention is within the field of door-stopping devices with applications more specifically in the area of doors for motor vehicles, the building sector and household appliances.

Description of the Related Art

We already know from the document FR 3 046 193, filed by the applicant, a door stop device that allows a swinging or a sliding door to be stopped and held in one of the multiple positions defined by retaining notches located on the connecting arm, as soon as the force required to open or close the door is interrupted, with possible applications specifically for the doors of motor vehicles.

Thus, the door stop device with multiple retaining positions described in FR 3 046 193 consists of, substantially:

- a connecting arm with multiple notches which may each hold a blocking element, thus ensuring the door stop device to be locked in multiple positions;
- a mobile carriage which slides along the connecting arm on which it is mounted while providing some resistance to movement, thus allowing the blocking element to be kept in an unlocked position while pressed against some inclined ramps which are part of the said mobile carriage, whenever a relative movement takes place between the connecting arm and the blocking mechanism, the door stop device being in this case in the unlocked mode. The relative resistance to movement between the connecting arm and the mobile carriage may be obtained by some friction simply generated between two contacting surfaces belonging to each of these two elements respectively, but also be obtained by adding a braking device which may consist of a brake pad linked to the mobile carriage and pressed by elastic means against a surface belonging to the connecting arm;
- a blocking element which is pressed by some elastic recall means inside anyone of the notches provided on the connecting arm, the said blocking element being itself mounted with a relative mobility on the blocking mechanism, following a direction with a component that is globally perpendicular to the connecting arm, in such a way that it may be removed from the notches of the said connecting arm in order to release this one;
- elastic recall means mounted on the blocking mechanism and cooperating directly or indirectly with the blocking element in a direction comprising a component globally perpendicular to the connecting arm. The elastic recall means may consist of a metal or plastic set, or also consist of a mixture of these materials, for example a set comprising a coil spring or elastic blades, or also a deformable element, such as an elastomer block.

However, this door-stop device is known to impose multiple but nevertheless predefined hold positions, so that the door cannot be held in any position, but only in one of the predefined positions, thus limiting the use of the entire travel actually available for the opening and holding of said door.

SUMMARY OF THE INVENTION

The present invention proposes a solution to overcome this disadvantage, while making the design of the door-stopping device significantly more robust: the present invention provides that the blocking element acts indirectly via a braking element which is pressed with some friction against at least one face of the linking arm, designed for this purpose, while a mobile carriage which may slide in longitudinal translation in relation to the linking arm on which it is mounted, and with limited travel in relation to the body of the said locking mechanism, is provided with inclined ramps designed to ensure the hold of that said blocking element when the door-stopping device is in an unlocked position, the said blocking element then no longer acting on the said braking element.

For this purpose, the invention concerns a door-stopping device, comprising a locking mechanism and a linking arm, one being linked to the leaf of the door, the other to the frame, the links with the frame and the leaf of the door being preferably articulated. The said linking arm comprises at least one face intended to cooperate with the said locking mechanism which comprises for this purpose a braking element pressed against the said face of the linking arm, the said braking element being controlled by a blocking element being itself mounted with a relative mobility on the said locking mechanism, following a direction that is globally perpendicular to the linking arm, and the said blocking element engaging inside a notch provided on the said braking element, while the said blocking element cooperates with resilient return means which act directly or indirectly on the said blocking element, in order to exert some pressure on the braking element, via the said blocking element, thus allowing the door to be relatively held open in any position between the closed position and the fully-open position, remarkable in that:

- said linking arm has at least one face intended to cooperate with the braking element described below and which is pressed against the said face of the linking arm, which face of the linking arm has a surface roughness whose characteristics allow a good friction grip between the said braking element and the said face of the linking arm, thus ensuring the locking of the door-stopping device in any position between the closed position and the full opening of the door;
- said locking mechanism comprises:
- at least one braking element having a face which can be pressed with a good grip on one face of the said linking arm facing the said face of the braking element, while the said braking element has at least one notch intended to receive a blocking element described below and which exerts some pressure on the said braking element when the door-stopping device is in locked mode, while the said braking element is mounted mobile in relation to the locking mechanism, with a direction parallel to the said linking arm and with a travel limited by elastic recall means which cooperate with the locking mechanism in order to bring said braking element back into the position where the said notch of the braking element is facing the said blocking element, as soon as said blocking element no longer exerts pressure on the said braking element, when the door-stopping device is in unlocked mode;

at least one blocking element which controls the said braking element by exerting some pressure, under the effect of resilient return means described below, in the notch provided for this purpose on said braking element, while said blocking element is itself mounted mobile on the locking mechanism, following a direction globally perpendicular to said linking arm, so that the said blocking element can be removed from the notch of said braking element, in order to release that braking element;

resilient return means, linked to the locking mechanism or to the blocking element, which act directly or indirectly between the said locking mechanism and said blocking element, following a direction globally perpendicular to the said linking arm. The resilient return means may consist of a metal or plastic set, or also consist of a mixture of these materials, for example a set comprising a coil spring or elastic blades, or also consist of a deformable element, such as an elastomer block;

a mobile carriage which may slide along the said linking arm on which it is mounted and with limited travel in relation to the body of the said locking mechanism, while providing some resistance to movement, thus allowing the said blocking element to be kept out of the said notch provided on the braking element, by leaning on inclined ramps provided on the said mobile carriage, when a relative movement appears between the linking arm and the locking mechanism, the door-stopping device being then in unlocked mode. The relative sliding resistance between the said linking arm and the said mobile carriage can be achieved by simple friction between two contacting surfaces belonging to each of these two elements respectively, but also by the addition of a braking device which may be made up of a brake pad fixed to the said mobile carriage and pushed by elastic means against a surface belonging to the said linking arm.

Variant of the braking element and the mobile carriage: in a preferred embodiment, the braking element and the mobile carriage may be fixed together in order to form a single part. The notch provided on the braking element and which is intended to receive the blocking element, will then be extended on each side by inclined ramps, the inclination of which will be preferably less than the inclination of the walls of the said notch provided on the braking element. The said inclined ramps will lean on a surface belonging to the said linking arm in order to react the force exerted by the said blocking element when the door-stopping device is in unlocked mode. The set obtained by combining the braking element and the mobile carriage together, will be able to slide along the said linking arm on which it is mounted and with limited travel in relation to the body of the said locking mechanism, while providing some resistance to movement, thus allowing to keep the said blocking element outside of the notch provided on the said set consisting of the braking element and the mobile carriage combined, by leaning on the inclined ramps provided on the said set consisting of the braking element and the mobile carriage combined, when a relative movement appears between the linking arm and the locking mechanism, the door-stopping device being then in unlocked mode. The relative sliding resistance between the linking arm and the said set consisting of the braking element and the mobile carriage combined, can be obtained by simple friction between two contacting surfaces belonging to each of these two elements respectively.

Variant of the resilient return means: in a preferred embodiment, a variant of the resilient return means may be formed of the addition of a transmission means provided between the resilient return means on the one hand, and the blocking element or the locking mechanism, on the other hand, the said transmission means being formed of at least two surface elements, at least one of which having a curved shape, the said surface elements cooperating with each other in a relative movement in two directions that are globally perpendicular to each other. The said surface elements cooperate in such a way as to transmit the load provided by the resilient return means and in such a way that the direction of the contact force transmitted at the contact point between the said surface elements, varies as the resilient return means are compressed. Thus, when the angle defined by the direction of the contact force transmitted at the contact point in relation to the compression direction of the resilient return means is small, then the perpendicular component acting on the said blocking element is small, which has an advantage in unlocked mode. Conversely, when the angle defined by the direction of the contact force transmitted at the contact point in relation to the compression direction of the resilient return means is close to 90°, then the perpendicular component acting on the blocking element is large, which has an advantage in locked mode. The intended purpose is to obtain a large holding force in locked mode, and to reduce the load of the said blocking element against the inclined ramps of the mobile carriage, when the door-stopping device is in unlocked mode, thus allowing to reduce the relative sliding resistance between the linking arm and the mobile carriage, needed to balance the forces to which the mobile carriage is subjected in said unlocked mode. Moving the door in unlocked mode then requires less effort.

Another variant of the resilient return means: according to the invention, the resilient return means are fixed to the locking mechanism or to the blocking element, and act directly or indirectly between the said locking mechanism and said blocking element, following a direction globally perpendicular to the linking arm. According to one of the embodiments of the resilient return means, the invention proposes to modulate the value of the force provided by said resilient return means, depending on the inclination of the locking mechanism, in order to allow the holding force to be modulated in locked mode, depending on the inclination of the said locking mechanism. To this end, the invention proposes to form the resilient return means by superimposing the effects of at least two distinct resilient return means, arranged in such a way that the loads they provide may add up in the same direction, when a mechanical link described below, comes to interpose between the said distinct resilient return means, or between one of the distinct resilient return means and the locking mechanism, simply under the effect of gravity. The mechanical link acting under the simple effect of gravity may be formed advantageously of a spherical ball housed in a resistant conical surface, the said resistant conical surface being fixed to one of the distinct resilient return means or fixed to the locking mechanism, said resistant conical surface being also centered in relation to a rigid surface located on the other distinct resilient return means or centered in relation to a rigid surface located on the locking mechanism, said rigid surface comprising in its center a cavity that may receive the spherical ball, when the resistant conical surface and rigid surface described above move towards each other as a result of the movement of the blocking element described above, while the spherical ball remains in the center of the resistant conical surface under the effect of gravity, the door-stopping device being not inclined at this moment. In this case, the ones of the distinct resilient return means which are not participating during the movement of the blocking element, are then not compressed and therefore do not contribute to the load transferred to the blocking element. Conversely, when the spherical ball leaves the center of the said resistant conical surface under the effect of gravity, because of an inclination beyond a predetermined threshold of the door-stopping device, the said spherical ball comes to interpose itself between the said resistant conical surface and the said rigid surface described above, thus constituting a mechanical link allowing the corresponding resilient return means to be compressed by the movement of said blocking element, thus causing a cumulative load provided by both of the distinct resilient return means. Thus, when the inclination of the door-stopping device remains below a certain predetermined threshold, one of the resilient return means is not affected by the movement of the blocking element and the resulting load on the said blocking element is lower. Conversely, when the inclination of the door-stopping device exceeds a predetermined threshold, the distinct resilient return means are operated simultaneously by the movement of the blocking element and the resulting load on said blocking element is greater.

BRIEF DESCRIPTION OF THE DRAWINGS

Other purposes and advantages of the present invention will appear in the description hereafter, which relates to an embodiment of the device proposed by the invention, to be considered as a non limitative example and the understanding of which can be made easier based on the drawings enclosed, which constitute schematic representations of the device proposed by the invention.

DESCRIPTION OF THE PREFERRED EMBODIMENTS

Figure 1A:
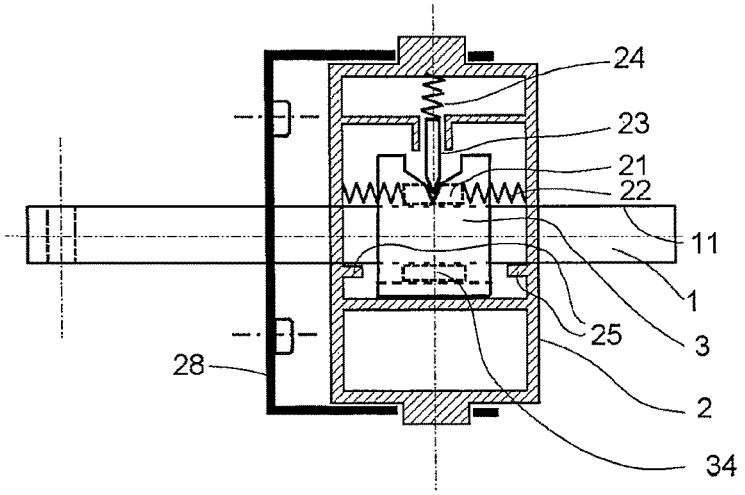
FIGS. 1A and 1B: representation of the door-stopping device comprising a linking arm (1) and a locking mechanism (2), while the door-stopping device is in locked mode.

The example of embodiment of the door-stopping device proposed by the present invention is formed of (FIGS. 1A and 1B):

A linking arm (1), preferentially articulated at one end, which may be linked to the door frame or to the door leaf, formed advantageously of an elongated and preferentially straight-shaped bar, made from a resistant material such as metal or a plastic used in the design of mechanical parts, comprising at least one face (11) intended to cooperate with a braking element (21) described below and pressed against said face (11) of the linking arm (1), which face (11) of the linking arm (1) has a surface roughness whose characteristics allow a good friction grip between the braking element (21) and the said face (11) of the linking arm (1), thus ensuring the locking of the door-stopping device in any position between the closed position and the full opening of the said door. The linking arm (1) may have at least one or preferentially two grooves (12) (FIGS. 3A and 3B), on one or more of its faces, in order to receive at least one or preferentially two ribs (33) belonging to the mobile carriage (3) described below, in order to allow the holding of said mobile carriage (3) in relation to the linking arm (1) while allowing a longitudinal sliding of said mobile carriage (3) in relation to the linking arm (1). The invention will not be altered if the arrangement of the grooves and ribs between the linking arm (1) and the mobile carriage (3) is reversed, which the person skilled in the art will understand as being obvious. Finally, the invention provides that the linking arm (1), mobile in relation to the locking mechanism (2) described below, may, in a preferential embodiment, slide in contact with a bearing zone (34), linked to the said mobile carriage (3) (FIGS. 4A and 4B), in order to react the load applied indirectly by the blocking element (23) described below, to the linking arm (1). The said bearing zone (34) may consist of a flat-shaped elastomer part whose surface roughness in the area which is in contact with the linking arm (1) will allow relative frictional braking between the said linking arm (1) and said mobile carriage (3), when a load is applied due to the force transmitted indirectly by the said blocking element (23) on the linking arm (1). The invention also provides that the linking arm (1) will be able to slide in contact with at least one bearing area (25), linked to the locking mechanism (2), having preferentially a flat and straight shape (FIGS. 1A and 1B), in order to react the loads applied indirectly by the blocking element (23) to said linking arm (1), while the locking mechanism (2) is in the locked or unlocked modes, hence allowing a relative guidance of said linking arm (1) in relation to the locking mechanism (2). The said bearing area (25) may simply consist of one or more ribs linked to the walls of the locking mechanism (2), which the person skilled in the art will be able to achieve without difficulty.

A locking mechanism (2) (FIGS. 1A and 1B), mobile in relation to the linking arm (1) and designed to be linked either to the leaf of the door or to the frame, by means of a preferentially articulated link having an axis which is perpendicular to the longitudinal axis of the linking arm (1), schematized here by means of a bracket (28) (FIGS. 1A and 1B), the said locking mechanism (2) being intended to cooperate with said linking arm (1) in order to keep the linking arm (1) locked in any position, as long as the door is not applied a force greater than the pre-defined unlocking force.

Figure 1B:
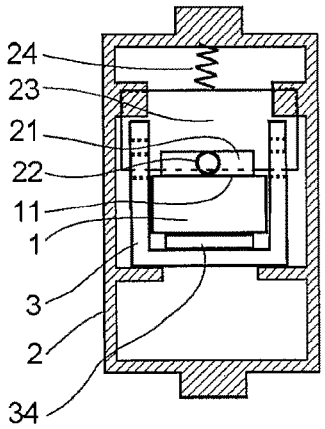
Figure 3A:
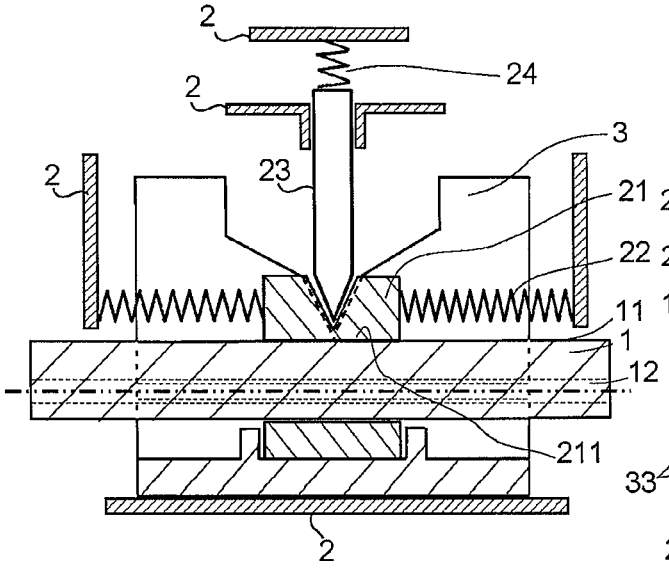
FIGS. 3A and 3B: linking arm (1), locking mechanism (2) and mobile carriage (3), while the door-stopping device is in locked mode.
Figure 3B:
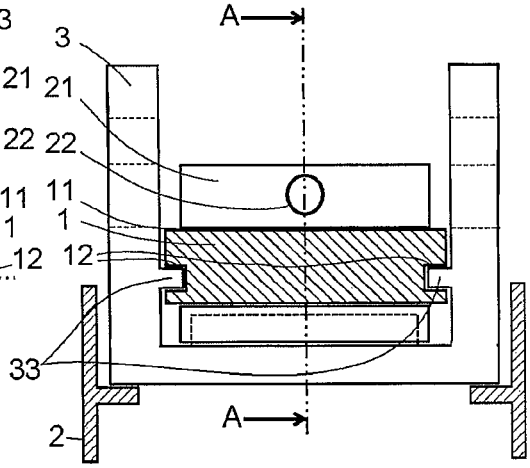
Figure 4A:
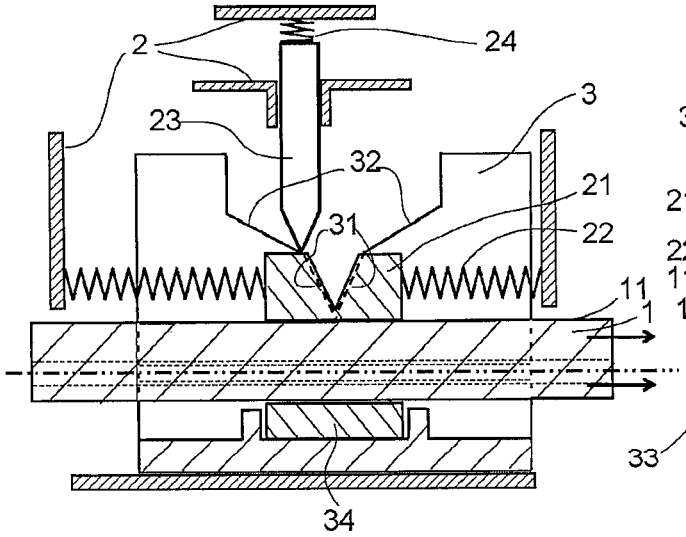
FIGS. 4A and 4B: linking arm (1), locking mechanism (2) and mobile carriage (3), while the door-stopping device is being unlocked.
Figure 4B:
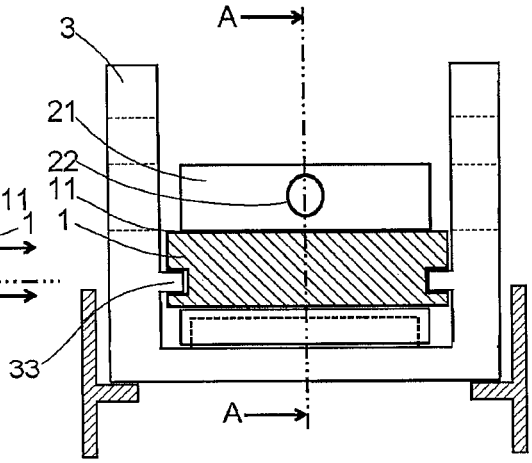
Figure 5A:
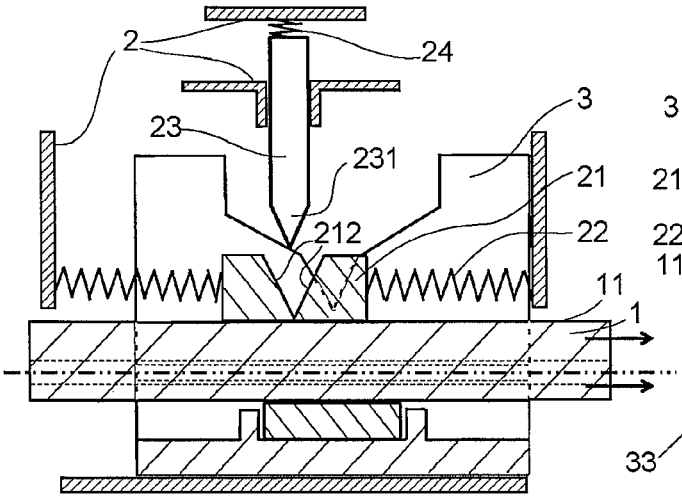
FIGS. 5A and 5B: linking arm (1), locking mechanism (2) and mobile carriage (3), while the door-stopping device is in unlocked mode.
Figure 5B:
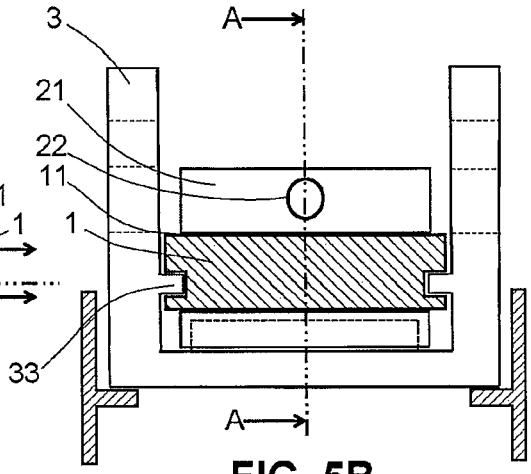

The said locking mechanism (2) comprises (FIGS. 3A and 3B):

a braking element (21), having a face (211) which can be pressed with good grip on a face (11) of the linking arm (1), facing the face (211) of the braking element (21), while said braking element (21) has a notch (212) (FIGS. 5A and 5B), intended to receive the blocking element (23) described below which exerts some pressure on the said braking element (21), when the door-stopping device is in locked mode. The said braking element (21) is also mounted mobile in relation to the locking mechanism (2) with a direction parallel to the linking arm (1) and with a travel limited by elastic recall means (22) which cooperate with the locking mechanism (2) in order to bring the said braking element (21) back to a central position, where the notch (212) of the said braking element (21) is facing the blocking element (23), as soon as the said blocking element (23) no longer exerts pressure on the braking element (21), which occurs when the door-stopping device is in unlocked mode (FIGS. 5A and 5B). The braking element (21) may consist of an elastomer block of a parallelepiped shape, for example, rigid enough to be able to carry out the notch (212) which will be provided with a V shape in the embodiment presented in this non-limiting example. Moreover, the elastomer material of the braking element (21), allows a good grip with the material used for the linking arm (1) which will itself be provided in metal or plastic in this example. Moreover, the grip between the linking arm (1) and the braking element (21) can also be obtained by any solutions well-known from the person skilled in the art, such as the addition of barbs, notches, streaks or grooves provided on the surfaces in contact, as non-limiting examples, without this altering the invention. Finally, the elastic recall means (22) will, in this example, consist of simple coil springs pressed against the walls of the locking mechanism (2) and arranged symmetrically on either side of the braking element (21) (FIGS. 3A and 3B);

a blocking element (23) (FIGS. 3A and 3B), which, under the effect of resilient return means (24) described below, may exert some pressure in the notch (212) provided on the braking element (21), said blocking element (23) being itself mounted mobile on the locking mechanism (2), following a direction globally perpendicular to the linking arm (1), so that said blocking element (23) can be removed from the said notch (212) provided on the braking element (21), in order to release the latter (FIGS. 4A and 4B). In the present example of embodiment proposed by the invention, the blocking element (23) will be provided with a triangular extremity (231), intended to fit the V section of the notch (212) provided on the braking element (21) (FIGS. 5A and 5B);

resilient return means (24) linked to the locking mechanism (2) or to the blocking element (23), by being pressed or anchored on a fixed part of the body of the locking mechanism (2) or by being pressed or anchored on the blocking element (23), such as summarily represented in the form of a simple coil spring schematized in FIGS. 1A and 1B, which can easily be achieved by the person skilled in the art. The invention provides that the said resilient return means (24) may act directly or indirectly between the said locking mechanism (2) and said blocking element (23), following a direction globally perpendicular to the linking arm (1);

a mobile carriage (3) (FIGS. 3A and 3B), which may slide along the linking arm (1) on which it is mounted and with limited travel in relation to the body of the locking mechanism (2), while the longitudinal translation guidance of the said mobile carriage (3) may be obtained by means of at least one, but preferably two ribs (33), adapted to slide into at least one, but preferably two grooves (12) provided on the linking arm (1), while offering some resistance to the relative movement between the said mobile carriage (3) and the linking arm (1), thus allowing the blocking element (23) to be kept outside of the notch (212) provided on the braking element (21), by having the said blocking element (23) lean on inclined ramps (32) described below, provided on the mobile carriage (3), (FIGS. 4A and 4B), when a relative movement appears between the linking arm (1) and the locking mechanism (2), the door-stopping device being then in unlocked mode. The relative sliding resistance between the linking arm (1) and the mobile carriage (3) can be achieved by simple friction between two contacting surfaces belonging to each of these two elements respectively, but also by the addition of a braking device not described here, which may be made up of at least one brake pad fixed to the mobile carriage (3) and pushed back by elastic means against a surface belonging to the linking arm (1), which the person skilled in the art will be able to achieve without difficulty. Also, the relative sliding resistance between the linking arm (1) and the mobile carriage (3) can be achieved by deforming a deformable part not described here, located on one of the faces of the linking arm (1) and being pressed against an embossment belonging to the mobile carriage (3), or otherwise pressed against a cylindrical roller, which may freely rotate while positioned in a semi-cylindrical cavity located on a part of the mobile carriage (3) which will be facing the said deformable part. The said deformable part may for example, be made from elastomer materials. The modes for obtaining relative sliding resistance between the linking arm (1) and the mobile carriage (3) described above, are not exhaustive and the person skilled in the art will be able to use other solutions available in the state of the art, without altering the invention.

Also, the mobile carriage (3) comprises, according to the invention, at least one but preferably two notches (31), the shape of which is in all or partly similar to the notch (212) provided on the braking element (21), as well as at least two inclined ramps (32) located on either side of each of the said notches (31) (FIGS. 4A and 4B). The invention also provides that the said inclined ramps (32) belonging to the mobile carriage (3) have an inclination relative to the longitudinal axis of the linking arm (1), which will be preferentially less steep than the inclination of the walls of the notches (31) of the said mobile carriage (3), in order to limit the force component which is parallel to the longitudinal axis of the linking arm (1), resulting from the load transmitted by the blocking element (23) on the said inclined ramps (32). According to the invention, the notches (31) of the mobile carriage (3) are designed to receive a part of the extremity (231) of the blocking element (23) and the said notches (31) will be, for this purpose, preferably located side by side with the notch (212) of the braking element (21), in such a way that when the blocking element (23) is fully pressed in said notch (212) in the locked position, then the notches (31) of the mobile carriage (3) will be juxtaposed and aligned with the notch (212), due to the load exerted by the blocking element (23) simultaneously on the notch (212) of the braking element (21) and on the notches (31) of the mobile carriage (3).

Figure 2A:
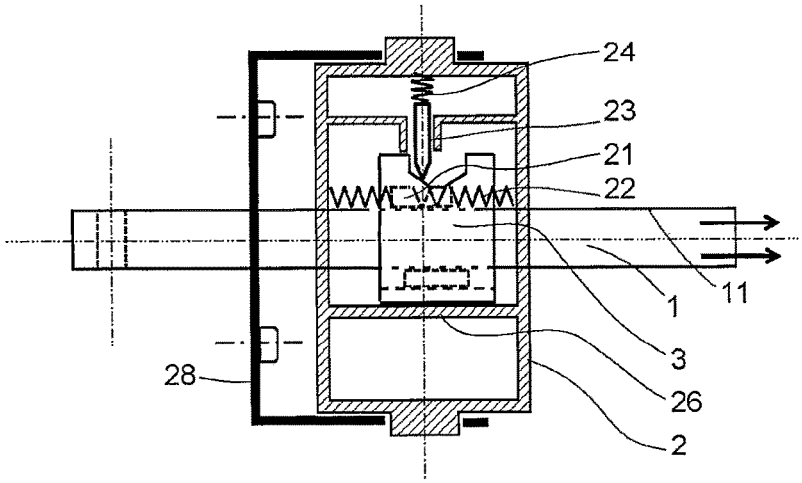
FIGS. 2A and 2B: representation of the door-stopping device comprising a linking arm (1) and a locking mechanism (2), while the door-stopping device is in unlocked mode.
Figure 2B:
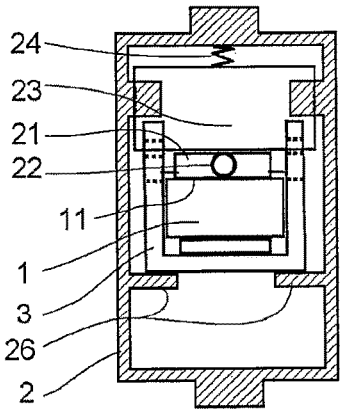

Whenever a force above a predefined threshold appears on the linking arm (1), while being in a locked position, the blocking element (23) is moved apart from the set composed of the notch (212) and notches (31), up to the point where the blocking element (23) is no longer in contact with the notch (212) of the braking element (21), the said blocking element (23) being therefore from this point, only held by the parts of the extremity (231) of the said blocking element (23), which were facing the notches (31) of the mobile carriage (3) and which are from now on, leaning on the inclined ramps (32) of the mobile carriage (3) (FIGS. 4A, 4B, 5A, and 5B). In this position, the linking arm (1) is no longer blocked in translation by the braking element (21) and the door-stopping device is in unlocked mode. In this phase, the mobile carriage (3) is mainly submitted to two opposite forces which are in a direction parallel to the longitudinal axis of the linking arm (1) and which are balanced. One of these forces results from the load exerted by the blocking element (23) on the inclined ramps (32) of the mobile carriage (3), load whose component which is parallel to the longitudinal axis of the linking arm (1) is balanced by a sliding resistance which appears between the mobile carriage (3) and the linking arm (1), said sliding resistance being due to the friction force applied to the mobile carriage (3), during its relative movement in relation to the linking arm (1). As soon as the movement of the linking arm (1) ceases in relation to the locking mechanism (2), whenever the door is left open in any position, the said sliding resistance disappears, thus breaking the balance of forces, and the blocking element (23), under the effect of the resilient return means (24), forces the notches (31) of the mobile carriage (3) to become aligned with the notch (212) of the braking element (21), while the extremity (231) of the blocking element (23) is then pressed in said notch (212). The door-stopping device is then again in a locked position. It should be noted that the notches (31) of the mobile carriage (3) could be placed not just beside the notch (212) of the braking element (21), but in a slightly different position as a result of limited available space for example, without modifying the present invention. In this case it would then be necessary to adapt the blocking element (23) accordingly, by providing one element that may be a substitute to the extremity (231) of the blocking element (23) and which may cooperate with the notches (31) of the mobile carriage (3). Finally, the invention provides that in a preferred embodiment, the mobile carriage (3) may lean or slide in contact with at least one bearing zone (26), provided on the locking mechanism (2), preferentially flat and straight in shape (FIGS. 2A and 2B), in order to react the loads applied directly or indirectly by the blocking element (23) on said mobile carriage (3), in the locked or unlocked modes of the locking mechanism (2). The said bearing zone (26) may simply consist of one or more ribs provided on the walls of the locking mechanism (2), which the person skilled in the art will be able to achieve without difficulty.

Figure 15A:
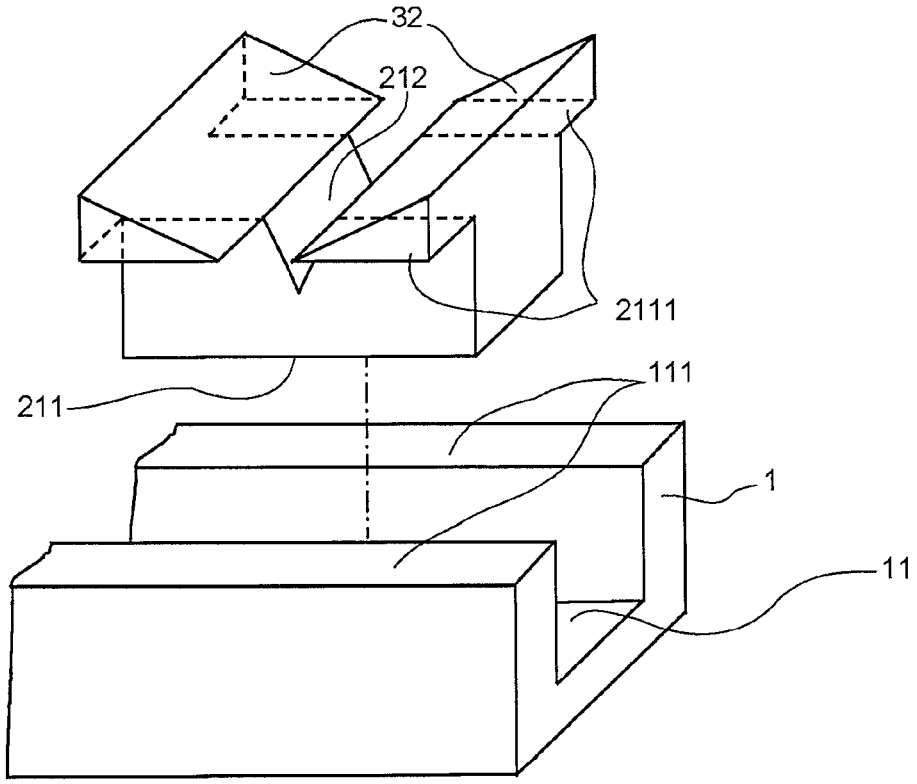
FIGS. 15A and 15B: variant of the braking element (21) and the mobile carriage (3) combined in one single part.
Figure 15B:
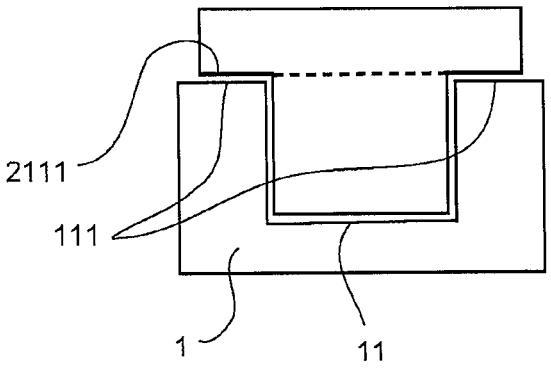

Variant of the braking element (21) and the mobile carriage (3) (FIGS. 15A and 15B): in a preferred embodiment, the braking element (21) and the mobile carriage (3) may be fixed together in order to form a single part. The notch (212) provided on the braking element (21) and which is intended to receive the blocking element (23), will then be extended on each side by inclined ramps (32), the inclination of which will be preferably less than the inclination of the walls of the said notch (212) provided on the braking element (21). The said inclined ramps (32) will lean on a surface (111) belonging to said linking arm (1), in order to react the force exerted by said blocking element (23) when the door-stopping device is in unlocked mode. The set then obtained by combining the braking element (21) and the mobile carriage (3) together, will be able to slide along the said linking arm (1) on which it is mounted and with limited travel in relation to the body of said locking mechanism (2), while providing some resistance to movement, thus allowing to keep the said blocking element (23) outside of the notch (212) that comprises the said set consisting of the braking element (21) and the mobile carriage (3) combined, by leaning on the inclined ramps (32) provided on the said set consisting of the braking element (21) and the mobile carriage (3) combined, when a relative movement appears between the linking arm (1) and the locking mechanism (2), the door-stopping device being then in unlocked mode. The relative sliding resistance between the linking arm (1) and the said set consisting of the braking element (21) and the mobile carriage (3) combined, can be achieved by simple friction between two contacting surfaces belonging to each of these two elements respectively. In the non-limiting example presented here, the surfaces (2111) belonging to the set consisting of the braking element (21) and the mobile carriage (3) combined, which are advantageously located under the inclined ramps (32), come into contact with the parts of surfaces (111) reserved for this purpose on the linking arm (1), thus producing resistance to displacement caused by the friction forces generated between the surfaces (2111) and surfaces (111). The set consisting of the braking element (21) and the mobile carriage (3) combined, can be made of an elastomer material, rigid enough to be able to carry out the notch (212) and the inclined ramps (32). Moreover, the elastomer material chosen will have a good grip with the material constituting the linking arm (1) which will be provided in metal or plastic for example.

Figure 6:
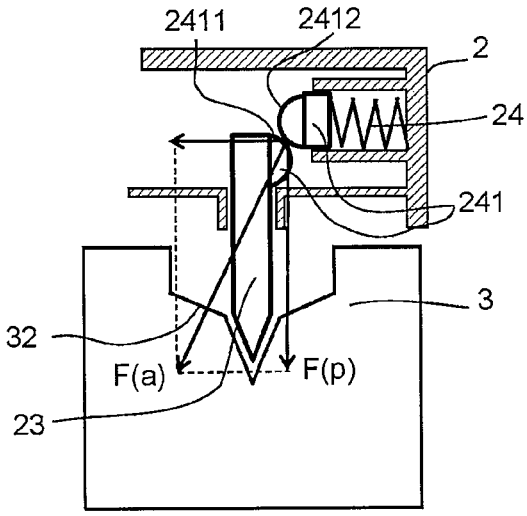
FIG. 6: variant of the resilient return means (24) in locked mode.
Figure 7:
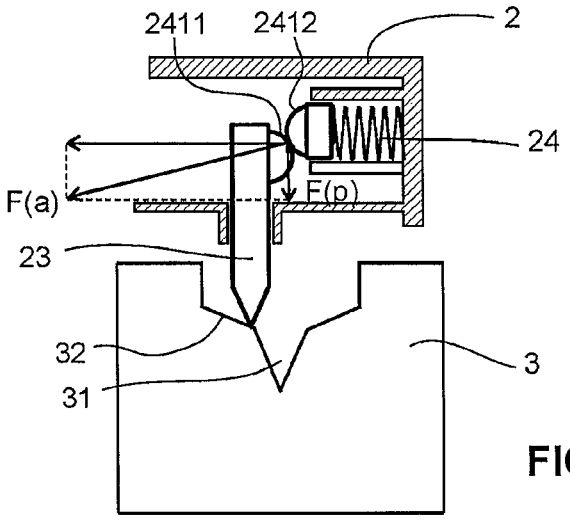
FIG. 7: variant of the resilient return means (24) in unlocked mode.
Figure 8:
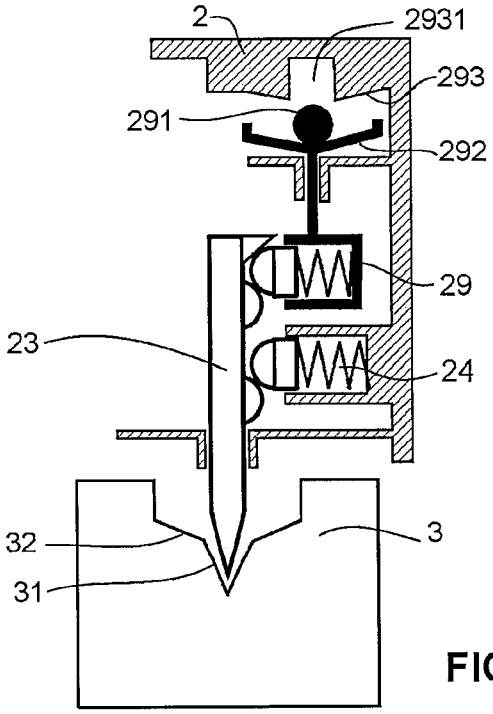
FIG. 8: another variant of the resilient return means (24), showing two distinct resilient return means (24) and (29), while the door-stopping device is in locked mode.
Figure 9:
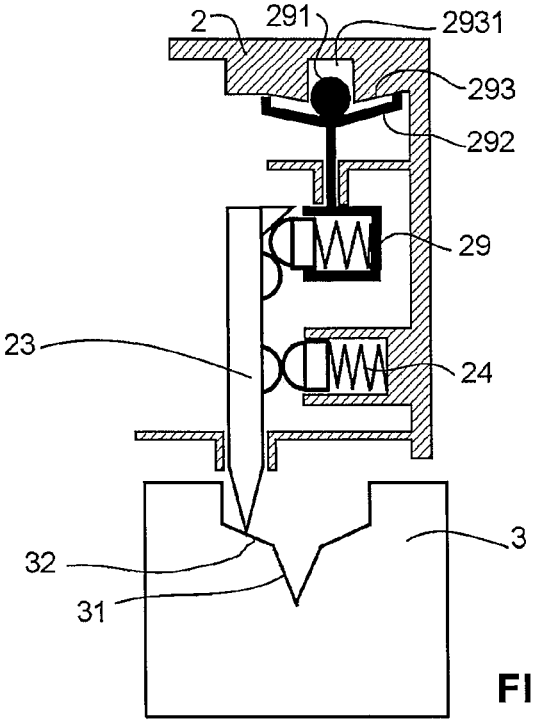
FIG. 9: another variant of the resilient return means (24), showing two distinct resilient return means (24) and (29), while the door-stopping device is in unlocked mode, not in an inclined position, without cumulating the loads.

Variant of the resilient return means (24) (FIG. 6 and FIG. 7): in a preferred embodiment, a variant of the resilient return means (24) may be formed from the addition of a transmission means (241) provided between the resilient return means (24) on the one hand, and the blocking element (23) or the locking mechanism (2) on the other hand, the said transmission means (241) being formed from at least two surface elements (2411) and (2412), at least one of which having a curved shape, the said surface elements (2411) and (2412) cooperating with each other in a relative movement in two directions which are globally perpendicular to each other, one of the said surface elements (2411) and (2412) being linked to the blocking element (23), the other of these said surface elements (2411) or (2412) being linked to the locking mechanism (2) through the resilient return means (24) to which it is submitted. The said surface elements (2411) and (2412) cooperate in order to transfer the load provided by the resilient return means (24), in such a way that the direction of the force F(a) shown in FIGS. 6 and 7, and which is transmitted at the contact point between the said surface elements (2411) and (2412), may vary while the resilient return means (24) are compressed. Thus, when the angle defined by the direction of the force F(a) transmitted at the contact point between said surface elements (2411) and (2412) in relation to the compression direction of the resilient return means (24) is small, then the perpendicular component F(p) shown in FIGS. 6 and 7, acting on the said blocking element (23), is small, which has an advantage in unlocked mode (FIG. 7). Conversely, when the angle defined by the direction of the force F(a) transmitted at the contact point defined above, relative to the compression direction of the resilient return means (24) is close to 90°, then the perpendicular component F(p) acting on the blocking element (23) is large, which has an advantage in locked mode (FIG. 6). The purpose here, is to reduce the load of the said blocking element (23) on the inclined ramps (32) of the mobile carriage (3), whenever the door-stopping device is in unlocked mode, thus allowing to reduce the relative sliding resistance between the linking arm (1) and the mobile carriage (3), required to balance the forces applied to the mobile carriage (3) in the said unlocked mode. Moving the door while it is in unlocked mode then requires less effort. It should be noted that in a preferred embodiment and without this altering the invention, the surface elements (2411) and (2412) may be integrated respectively to the blocking element (23), as an embossment in the case of the surface element (2411), and integrated to the resilient return means (24) in the case of the surface element (2412), as for example, when the resilient return means (24) are made of elastic blades having a curved extremity, well known in the state of the art.

Figure 10:
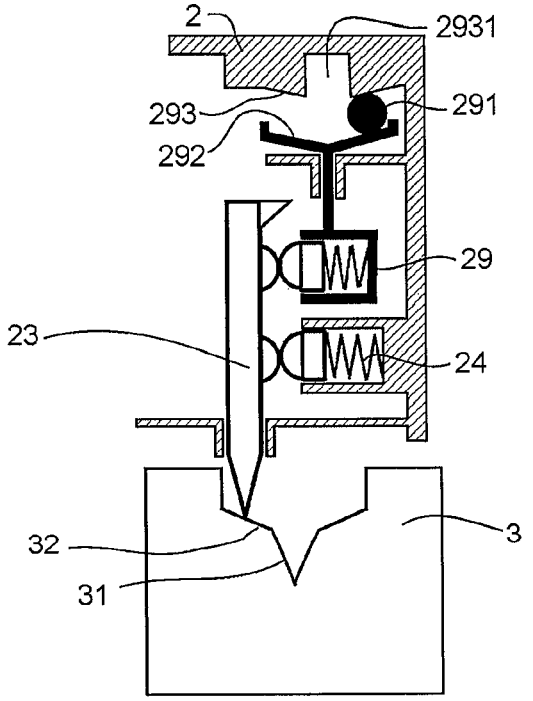
FIG. 10: another variant of the resilient return means (24), showing two distinct resilient return means (24) and (29), while the door-stopping device is in unlocked mode, in an inclined position, with cumulative loads.
Figure 11:
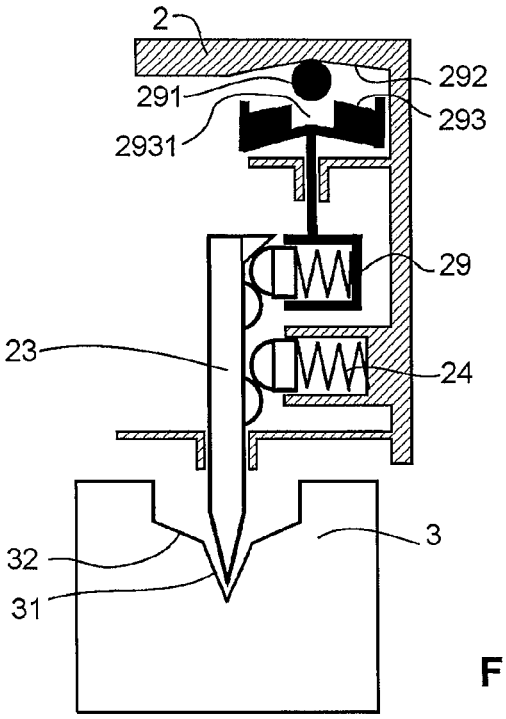
FIG. 11: another variant of the resilient return means (24), showing two distinct resilient return means (24) and (29), with the resistant conical surface (292) being fixed to the locking mechanism (2), while the door-stopping device is in locked mode.
Figure 12:
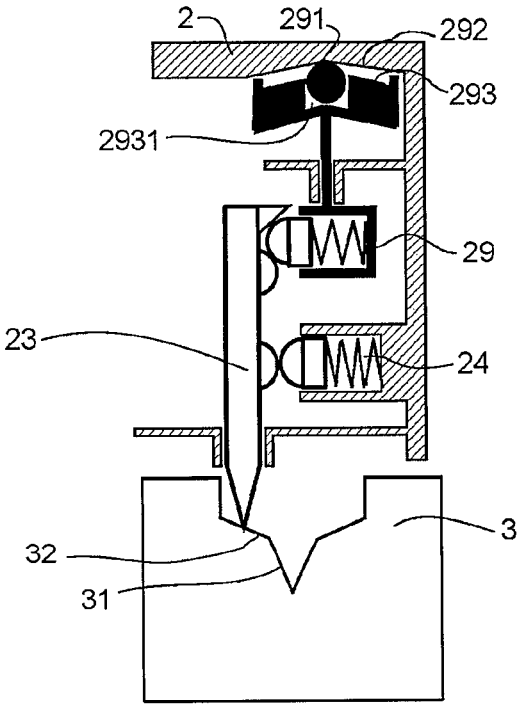
FIG. 12: another variant of the resilient return means (24), showing two distinct resilient return means (24) and (29), with the resistant conical surface (292) being fixed to the locking mechanism (2), while the door-stopping device is in unlocked mode, not in an inclined position, without cumulating the loads.
Figure 13:
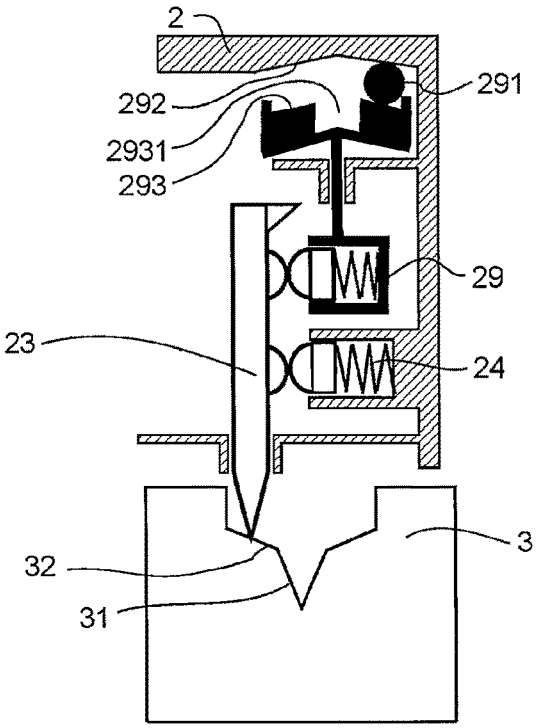
FIG. 13: another variant of the resilient return means (24), showing two distinct resilient return means (24) and (29), with the resistant conical surface (292) being fixed to the locking mechanism (2), while the door-stopping device is in unlocked mode, in an inclined position, with cumulative loads.

Another Variant of the Resilient Return Means (24)—(FIG. 8 to FIG. 13):

According to the invention, the resilient return means (24) are fixed to the locking mechanism (2) or to the blocking element (23) and act directly or indirectly between the said locking mechanism (2) and the said blocking element (23), following a direction globally perpendicular to the linking arm (1). According to one of the embodiments of the resilient return means (24), the invention proposes to modulate the value of the load provided by said resilient return means (24), depending on the inclination of the locking mechanism (2), in order to allow the hold force to be modulated in the locked mode, depending on the inclination of said locking mechanism (2). To this end, the invention proposes to replace the resilient return means (24), by superimposing the effects of at least two distinct resilient return means (24) and (29) (FIG. 8), arranged in such a way that the loads they provide may add up in the same direction, when a mechanical link (291) described below, comes to interpose under the simple effect of gravity, between the said distinct resilient return means (24) and (29), or between one of the distinct resilient return means (24) or (29) and the locking mechanism (2). In the present embodiment example proposed by the invention, we will choose to interpose a mechanical link (291) between the resilient return means (29) made according to the first variant outlined above, and the locking mechanism (2). The mechanical link (291) acting under the simple effect of gravity can be formed advantageously of a spherical ball (291), housed in a resistant conical surface (292) (FIG. 8), the said resistant conical surface (292) being mechanically linked to the resilient return means (29) (FIG. 8), by any means known in the state of the art or also, without this changing the invention, the said resistant conical surface (292) being linked to the locking mechanism (2) (FIG. 11), with in this case, a mounting of the door-stopping device in an inverted position ("upside down") relative to the illustration presented in FIG. 8. The said resistant conical surface (292) is also centered in relation to a rigid surface (293) which is located on the locking mechanism (2) (FIG. 8), or otherwise located on a part linked to the resilient return means (29) (FIG. 11), when the resistant conical surface (292) is itself linked to the locking mechanism (2). The said rigid surface (293) comprises in its center a cavity (2931), which may receive the spherical ball (291) when the resistant conical surface (292) and the rigid surface (293) move towards each other, (FIG. 9 and FIG. 12), as a result of the movement of the blocking element (23), while the spherical ball (291) remains in the center of the resistant conical surface (292), under the effect of gravity. In this case, the resilient return means (29) are not compressed by the movement of the blocking element (23), and therefore do not contribute to the load inflicted to the blocking element (23). Conversely, when the spherical ball (291) leaves the center of the resistant conical surface (292) under the effect of gravity, due to an inclination of the door-stopping device beyond a threshold predetermined by the angle of the cone formed by the resistant conical surface (292), the said spherical ball (291) comes to interpose itself between the resistant conical surface (292) and the rigid surface (293), thus constituting a mechanical link allowing the resilient return means (29) to be compressed by the movement of the blocking element (23), thus causing a cumulative load provided by the distinct resilient return means (24) and (29) (FIG. 10 and FIG. 13). Thus, when the inclination of the door-stopping device remains below a certain predetermined threshold, the resilient return means (29) are not affected by the movement of the blocking element (23) and the resulting load on the said blocking element (23) is smaller. Conversely, when the inclination of the door-stopping device exceeds a certain predetermined threshold, the resilient return means (29) are operated at the same time as the resilient return means (24) by the displacement of the blocking element (23) and the resulting load on the said blocking element (23) is greater.

Figure 14A:
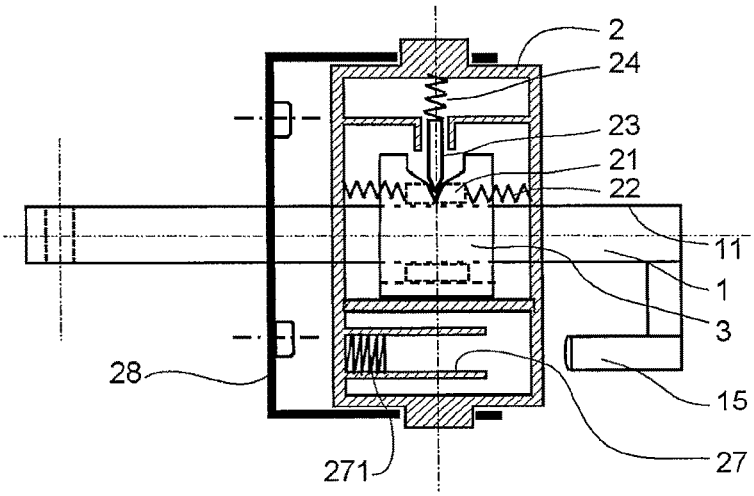
FIGS. 14A and 14B: variant of the linking arm (1) comprising a cylindrical part (15).
Figure 14B:
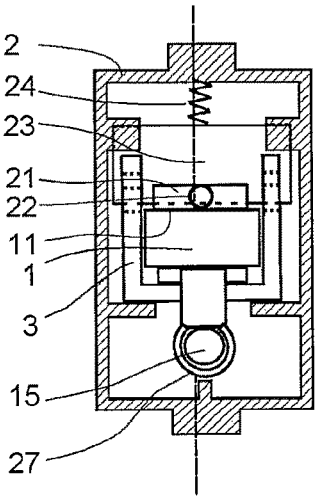

Variant of the Linking Arm (1) (FIGS. 14A and 14B):

The linking arm (1), described above, provides the link between the frame of the door and the locking mechanism (2) when the latter is mounted on the door leaf. Conversely, if the locking mechanism (2) is designed to be mounted on the frame of the door, then the linking arm (1) provides the link between the door leaf and the locking mechanism (2). In either case, during the opening or closing of the door, the linking arm (1) transmits the forces resulting from the relative movement of the door, the locking mechanism (2) being then in the unlocked mode. Moreover, the linking arm (1) transmits the hold force needed to keep the door open in a fixed position when the locking mechanism (2) is in a locked position. Also, when the door reaches its fully open position, it may be interesting, as it is the case with most of the door-stopping devices known in the state of the art, to provide a so-called "end stop" device, designed to ensure that the linking arm (1) will stop the door so that it cannot go beyond its full opening point, which could otherwise damage the door or also the body of the motor vehicle. The end stop devices known in the state of the art are generally designed as a hard stop, sometimes fitted with pads made of elastic material in order to reduce the shocks whenever the door is opened too roughly. Also, the invention provides that the linking arm (1) may comprise at its free end, a cylindrical part (15), places beside the said linking arm (1), preferentially located opposite to face (11), which face (11) is intended to cooperate with the braking element (21), the axis of said cylindrical part (15) being preferentially parallel to the longitudinal axis of the linking arm (1). The said cylindrical part (15) will be designed to penetrate into a cylindrical cavity (27), which is mounted on the locking mechanism (2), said cylindrical cavity (27) being itself designed in such a way that the dimensions of its cross section be only barely larger than the dimensions of the cross section of the cylindrical part (15), so that the penetration of this cylindrical part (15) inside the cylindrical cavity (27) takes place with a reduced clearance between the walls of those two parts, whenever the door gets fully opened. The purpose is to trap a volume of compressed air inside the cylindrical cavity (27), as a result of the penetration of the cylindrical part (15) which then acts like a piston, thus damping the end of stroke of the linking arm (1). Also, just after the linking arm (1) is immobilized in its end of stroke position, the possible leakage between the walls of the cylindrical part (15) and the cylindrical cavity (27) will quickly cause a pressure drop of the air trapped inside the cylindrical cavity (27). The invention also provides that the cylindrical cavity (27) can be made of some elastomer material, in such a way that the dimensions of the cross section of said cylindrical cavity (27) be slightly smaller than the dimensions of the cross section of the cylindrical part (15), so that the penetration of said cylindrical part (15) inside the said cylindrical cavity (27) occurs with a braking effect, due to the deformation of the elastomer material forming the cylindrical cavity (27) during the penetration of the cylindrical part (15). Finally, the invention provides that an elastic element (271) may be placed inside the cylindrical cavity (27), in order to help dampen the end of stroke of the linking arm (1), thanks to the compression of the elastic element (271) by the cylindrical part (15), when this latter penetrates into the cylindrical cavity (27). The elastic element (271) will not be described here, but may be constituted as a non-limiting example, by a coil spring, an elastomer block or any other elastically deformable element, known in the state of the art.

The invention claimed is:

1. A door-stopping device, comprising:

a linking arm (1); and a locking mechanism (2), a first of the linking arm and the locking mechanism being linked to a door leaf, and a second of the linking arm and the locking mechanism being linked to a frame, said linking arm (1) having a first face (11) configured to cooperate with said locking mechanism (2), said locking mechanism including a braking element (21) that is pressed against said first face (11) of the linking arm (1), said braking element (21) controlled by a blocking element (23) mounted movably on the locking mechanism (2), following a direction globally perpendicular to the linking arm (1), said blocking element (23) engaging into a first notch (212) provided on the braking element (21), and said blocking element (23) cooperating with a resilient return means (24) which acts directly or indirectly on said blocking element (23) to exert pressure via said blocking element (23) on the braking element (21), thus holding the door leaf relative to the frame in any open position between a closed position and a fully-open position, wherein:

said first face (11) of the linking arm (1) has a surface roughness that provides friction grip between the braking element (21) and the first face (11) of the linking arm (1);

said braking element (21) has a second face (211) which is configured to be pressed with a portion of said first face (11) of the linking arm (1);

said braking element (21) is mounted movably in relation to the locking mechanism (2), said braking element movable in a direction parallel to the linking arm (1) and with a travel limited by elastic recall means (22) which cooperate with the locking mechanism (2) in order to bring said braking element (21) back to a position where said first notch (212) of the braking element (21) is facing the blocking element (23) as soon as said blocking element (23) no longer exerts pressure on said braking element (21), while the door-stopping device is in an unlocked mode;

said blocking element (23) is configured to be removed from the first notch (212) provided on the braking element (21) in order to release said braking element (21);

the resilient return means (24), linked either to the locking mechanism (2) or to the blocking element (23), acts directly or indirectly between said locking mechanism (2) and said blocking element (23), following a direction perpendicular to the linking arm (1);

a mobile carriage (3) is slideable along the linking arm (1) on which the mobile carriage (3) is mounted and with limited travel in relation to the body of the locking mechanism (2), while providing resistance to the relative movement between said mobile carriage (3) and the linking arm (1);

said mobile carriage (3) comprises a second notch (31) with a shape which is similar to the first notch (212)

provided on the braking element (21), and said mobile carriage (3) further comprises two inclined ramps (32) located on opposite sides of said second notch (31) of the mobile carriage (3) and which are configured to hold the blocking element (23) when the door-stopping device is in the unlocked position, said second notch (31) of the mobile carriage (3) configured to receive an extremity (231) of the blocking element (23), and said second notch (31) of the mobile carriage (3) is configured to be positioned side by side with the first notch (212) of the braking element (21) in such a way that when the blocking element (23) is fully pressed in the first notch (212) in a locked position, then the second notch (31) of the mobile carriage (3) is juxtaposed and aligned with the first notch (212) of the braking element (21), as a result of a load exerted by the blocking element (23); and when a force greater than a predefined threshold is applied to the linking arm (1), the blocking element (23) is moved apart from the first notch (212) and the second notch (31), up to a point where the blocking element (23) is no longer in contact with the first notch (212) of the braking element (21), then said blocking element (23) is only held by the extremity (231) of said blocking element (23), which is leaning on the inclined ramps (32) of the mobile carriage (3), the linking arm (1) being no longer blocked in translation by the braking element (21) and the door-stopping device being then in an unlocked mode.

2. The door-stopping device according to claim 1, wherein the resilient return means (24) further comprise a transmission means (241) provided between the resilient return means (24) and either the blocking element (23) or the locking mechanism (2), said transmission means (241) being formed of two surface elements (2411, 2412), at least one of said surface elements having a curved shape, said surface elements (2411, 2412) cooperating with each other in a relative movement in two directions that are perpendicular to each other, said surface elements (2411, 2412) cooperate in such a way as to transfer a load provided by the resilient return means (24) in such a way that a direction of a force transmitted at a contact point between said surface elements (2411, 2412) is configured to vary while the resilient return means (24) are compressed.

3. The door-stopping device according to claim 1, wherein the resilient return means (24) comprises two distinct resilient return means (24, 29), the two distinct resilient return means being configured such that respective loads applied by the two distinct resilient return means act in a same direction when a mechanical link comprised of a spherical ball (291) interposes under gravity either between said distinct resilient return means (24, 29) or between the resilient return means (29) and the locking mechanism (2), while said spherical ball (291) is housed in a resistant conical surface (292) which is mechanically linked to either of the resilient return means (29) or to the locking mechanism (2), said resistant conical surface (292) being also centered in relation to a rigid surface (293) located on the locking mechanism (2) or linked to the resilient return means (29), said rigid surface (293) comprising in a center thereof a cavity (2931), which is configured to receive the spherical ball (291) when the resistant conical surface (292) and the rigid surface (293) move towards each other as a result of movement of the blocking element (23), while the spherical ball (291) remains in the center of the resistant conical surface (292), under the effect of gravity, the resilient return means (29) thus not being compressed by the movement of the blocking element (23), and while, conversely, when the spherical ball (291) leaves the center of the resistant conical surface (292) due to an inclination of the door-stopping device, said spherical ball (291) comes to interpose itself between the resistant conical surface (292) and the rigid surface (293), allowing the resilient return means (29) to be compressed by the movement of the blocking element (23), thus allowing a cumulative load to be provided by the distinct resilient return means (24, 29).

4. The door-stopping device according to claim 1, wherein the linking arm (1) comprises at a free end thereof a cylindrical part (15) located beside said linking arm (1) and configured to penetrate into a cylindrical cavity (27) provided on the locking mechanism (2), while dimensions of a cross section of said cylindrical cavity (27) are larger than dimensions of a cross section of cylindrical part (15), so that penetration of the cylindrical part (15) inside the cylindrical cavity (27) takes place with a reduced clearance between respective walls of the cylindrical part (15) and the cylindrical cavity (27), when the door is fully opened, while an elastic element (271) is placed inside the cylindrical cavity (27), in order to dampen an end of stroke of the linking arm (1) due to a compression of the elastic element (271) by the cylindrical part (15), when the cylindrical part (15) penetrates into the cylindrical cavity (27).

5. The door-stopping device according to claim 4, wherein the cylindrical cavity (27) is made of elastomer material, so that penetration of said cylindrical part (15) inside said cylindrical cavity (27) occurs with a braking effect due to deformation of the elastomer material forming the cylindrical cavity (27) during the penetration of the cylindrical part (15).

6. A door of a motor vehicle comprising a door-stopping device according to claim 1.

7. A building door comprising a door-stopping device according to claim 1.

8. The door-stopping device according to claim 2, wherein the linking arm (1) comprises at a free end thereof a cylindrical part (15) located beside said linking arm (1) and configured to penetrate into a cylindrical cavity (27) provided on the locking mechanism (2), while dimensions of a cross section of said cylindrical cavity (27) are larger than dimensions of a cross section of cylindrical part (15), so that penetration of the cylindrical part (15) inside the cylindrical cavity (27) takes place with a reduced clearance between respective walls of the cylindrical part (15) and the cylindrical cavity (27), when the door is fully opened, while an elastic element (271) is placed inside the cylindrical cavity (27), in order to dampen an end of stroke of the linking arm (1) due to a compression of the elastic element (271) by the cylindrical part (15), when the cylindrical part (15) penetrates into the cylindrical cavity (27).

9. The door-stopping device according to claim 3, wherein the linking arm (1) comprises at a free end thereof a cylindrical part (15) located beside said linking arm (1) and configured to penetrate into a cylindrical cavity (27) provided on the locking mechanism (2), while dimensions of a cross section of said cylindrical cavity (27) are larger than dimensions of a cross section of cylindrical part (15), so that penetration of the cylindrical part (15) inside the cylindrical cavity (27) takes place with a reduced clearance between respective walls of the cylindrical part (15) and the cylindrical cavity (27), when the door is fully opened, while an elastic element (271) is placed inside the cylindrical cavity (27), in order to dampen an end of stroke of the linking arm (1) due to a compression of the elastic element (271) by the cylindrical part (15), when the cylindrical part (15) penetrates into the cylindrical cavity (27).

10. A door of a motor vehicle comprising a door-stopping device according to claim 2.

11. A door of a motor vehicle comprising a door-stopping device according to claim 3.

12. A door of a motor vehicle comprising a door-stopping device according to claim 4.

13. A door of a motor vehicle comprising a door-stopping device according to claim 5.

14. A building door comprising a door-stopping device according to claim 2.

15. A building door comprising a door-stopping device according to claim 3.

* * * * *